US006182841B1

(12) United States Patent
Klein

(10) Patent No.: US 6,182,841 B1
(45) Date of Patent: Feb. 6, 2001

(54) DISPLAY SYSTEM FOR LAMP SHADES

(75) Inventor: Monroe J. Klein, Staten Island, NY (US)

(73) Assignee: Arthur J. Kein & Co., Inc., Staten Island, NY (US)

( * ) Notice: Under 35 U.S.C. 154(b), the term of this patent shall be extended for 0 days.

(21) Appl. No.: 09/425,355

(22) Filed: Oct. 22, 1999

(51) Int. Cl.[7] ..... A47F 7/00

(52) U.S. Cl. ..... 211/85.14; 211/163; 211/59.1; 211/49.1

(58) Field of Search ..... 211/13.1, 59.1, 211/49.1, 85.14, 163

(56) References Cited

U.S. PATENT DOCUMENTS

| | | | | |
|---|---|---|---|---|
| D. 96,363 | | 7/1935 | Arnold . | |
| 201,656 | * | 3/1878 | Dunn | 211/59.1 X |
| 410,175 | | 9/1889 | McAllister . | |
| 1,620,148 | | 3/1927 | Williams . | |
| 2,284,518 | * | 5/1942 | Green | 211/59.1 X |
| 2,890,801 | | 6/1959 | Ladd et al. . | |
| 4,971,234 | | 11/1990 | Hay . | |
| 4,991,726 | | 2/1991 | Johnson . | |
| 5,839,586 | | 11/1998 | Smith . | |
| 5,996,819 | * | 12/1999 | Klein | 211/85.14 |

* cited by examiner

*Primary Examiner*—Robert W. Gibson, Jr.
(74) *Attorney, Agent, or Firm*—Cummings & Lockwood

(57) ABSTRACT

A display system for lamp shades includes a lower portion and an upper portion. The lower portion has opposed top and bottom surfaces. Struts depend from the bottom surface of the lower portion to secure the lower portion to a supporting structure. A plurality of upstanding posts extend from the top surface of the lower portion to support nested lamp shades in a manner suitable for display. An axial mast extends from the central axis of the top surface of the lower portion. The upper portion has opposed top and bottom surfaces. A pole depends from the bottom surface of the upper portion to cooperate with the axial mast of the lower portion so as to facilitate rotation of the upper portion relative to the lower portion. A plurality of upstanding posts extend from the upper surface of the upper portion to support nested lamp shades in a manner suitable for display.

14 Claims, 3 Drawing Sheets

DISPLAY SYSTEM FOR LAMP SHADES

BACKGROUND OF THE INVENTION

1. Field of the Invention

The subject invention relates to a merchandise display system, and more particularly, to a system for displaying a plurality of nested lamp shades in a convenient and efficient manner.

2. Background of the Related Art

It has become commonplace for merchants of household goods to display lamp shades on linear shelves. This practice necessarily requires the use of a vast amount of valuable shelf space. In some instances, an entire aisle of a store may be devoted to the display of a wide assortment of lamp shades of various size, style and color. Lamp shades displayed in this manner often become displaced and unorganized, making the shelves appear rather unsightly.

It is also desirable for merchants of household goods to display pattern and color coordinated items in close proximity to each other as a suggestive selling method to maximize profits. For example, a store presentation could consist of bedding, window treatments, wallpaper, bathroom accessories and lamp shades which are coordinated patterns or colors.

It would be beneficial to merchants of household goods to provide an apparatus for displaying a plurality of lamp shades of various size, style and color in a manner which would conserve valuable shelf space, accommodate a variety of coordinated merchandise and improve the aesthetic characteristics of a store.

SUMMARY OF THE INVENTION

The subject invention is directed to a display system for presenting a plurality of nested lamp shades in a unique manner which facilitates the ready removal of a selected stack of nested lamp shades from the display system.

In accordance with a preferred embodiment of the subject invention, the display system includes an elongated base portion having opposed top and bottom planar surfaces defining a longitudinal axis and a central axis which extends generally perpendicular to the longitudinal axis. First and second upstanding posts extend from the top surface of the base portion. The first upstanding post is disposed between a first end of the elongated base portion and the central axis, and the second upstanding post is disposed between a second end of the elongated base portion and the central axis.

Each upstanding post has an upper portion with an upper diameter and a lower portion with a lower diameter. The upper diameter is less than the lower diameter so as to form a shoulder area upon which a stack of nested lamp shades can rest. First and second mounting struts depend from the bottom surface of the elongated base portion for securing the base portion to a supporting structure. The mounting struts may be aligned with the upstanding posts. It is envisioned that the elongated base portion may have a third upstanding post in axial alignment with the central axis to support a third stack of nested lamp shades.

In another preferred embodiment, the elongated base portion has an upstanding axial mast in axial alignment with the central axis to support a rotatable display member. The upstanding axial mast is configured to facilitate selective vertical positioning of the display member along the central axis. The display member, having opposed top and bottom planar surfaces, is defined by an elongated shelf having at least first and second upstanding posts extending from the top surface and a pole depending from the bottom surface.

In a still another preferred embodiment, the display member has a hub portion and at least two circumferentially spaced apart radially extending arms. It is envisioned that the upstanding post on each arm of the display member is centrally disposed between the hub portion of the display member and a radially outer end of that arm. Thus, when a plurality of nested lamp shades are positioned on each upstanding post, the display system will be well balanced. In use, the second display member is rotatable with respect to the lower portion to facilitate the movement of a selected stack of nested lamp shades to a position in which the selected stack of nested lamp shades is readily removable from the display system.

These and other unique features of the display system of the subject invention will become more readily apparent from the following description of the drawings.

BRIEF DESCRIPTION OF THE DRAWINGS

So that those having ordinary skill in the art to which the subject invention appertains will more readily understand how to construct and use the lamp shade display system of the subject invention, reference may be had to the drawings wherein.

Figure 1:
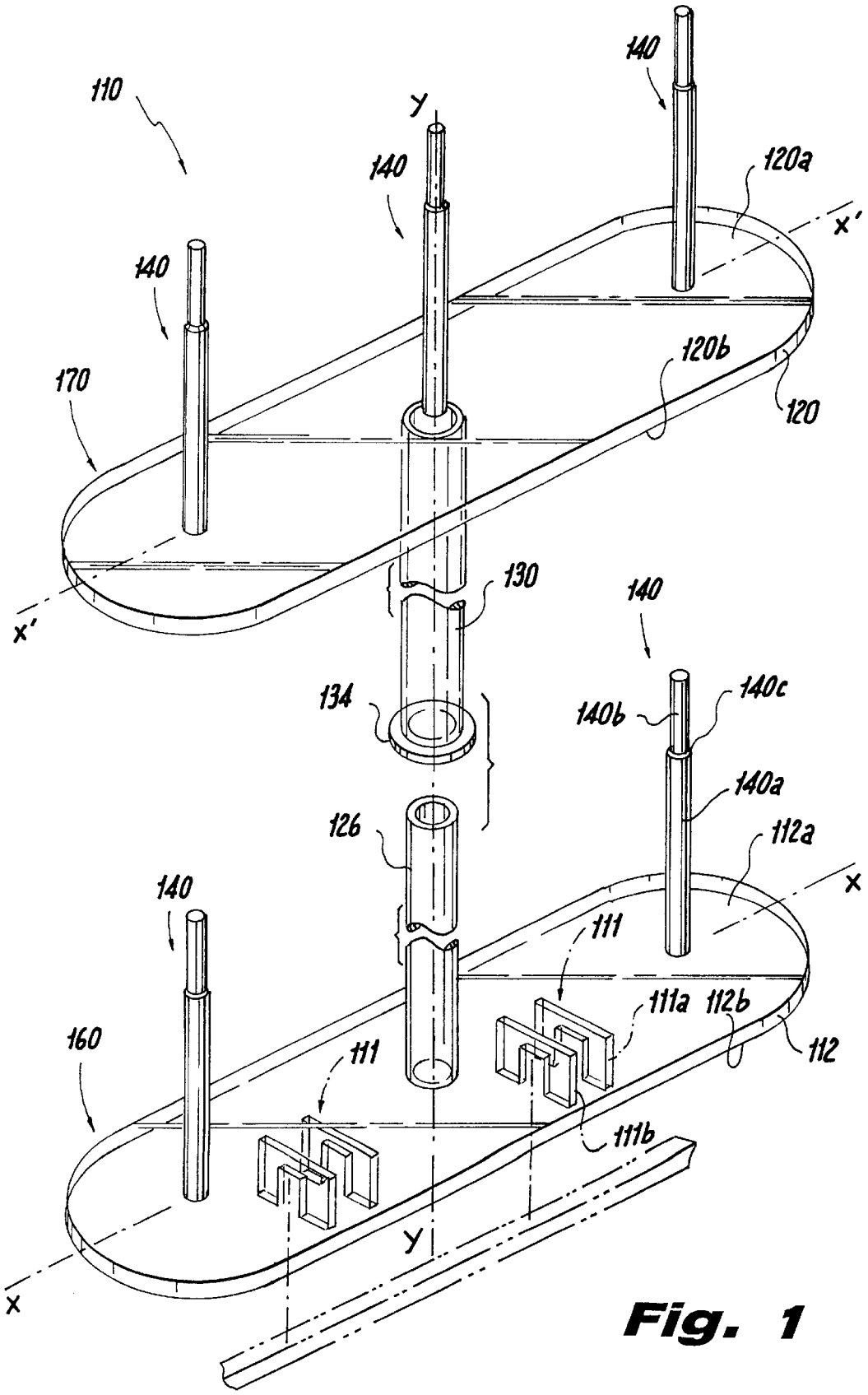
FIG. 1 is a perspective view of a display system constructed in accordance with a preferred embodiment of the subject invention.

These and other features of the lamp shade display system of the subject invention will become more readily apparent to those having ordinary skill in the art from the following detailed description of the invention taken in conjunction with the drawings.

DETAILED DESCRIPTION OF THE PREFERRED EMBODIMENTS

Referring now to the drawings wherein like reference numerals identify similar structural elements, there is illustrated a lamp shade display apparatus constructed in accordance with preferred embodiments of the subject invention and designated generally by the reference numeral 110. The structural components of display apparatus 110 are preferably formed from a lightweight plastic, such as, for example, polyvinyl chloride (PVC) or acrylic. However, it is envisioned that the many of the components of display apparatus may be formed from a lightweight metal, such as, for example, stainless steel or aluminum. Alternatively, various components of display apparatus may be constructed from a decorative wood.

Figure 2:
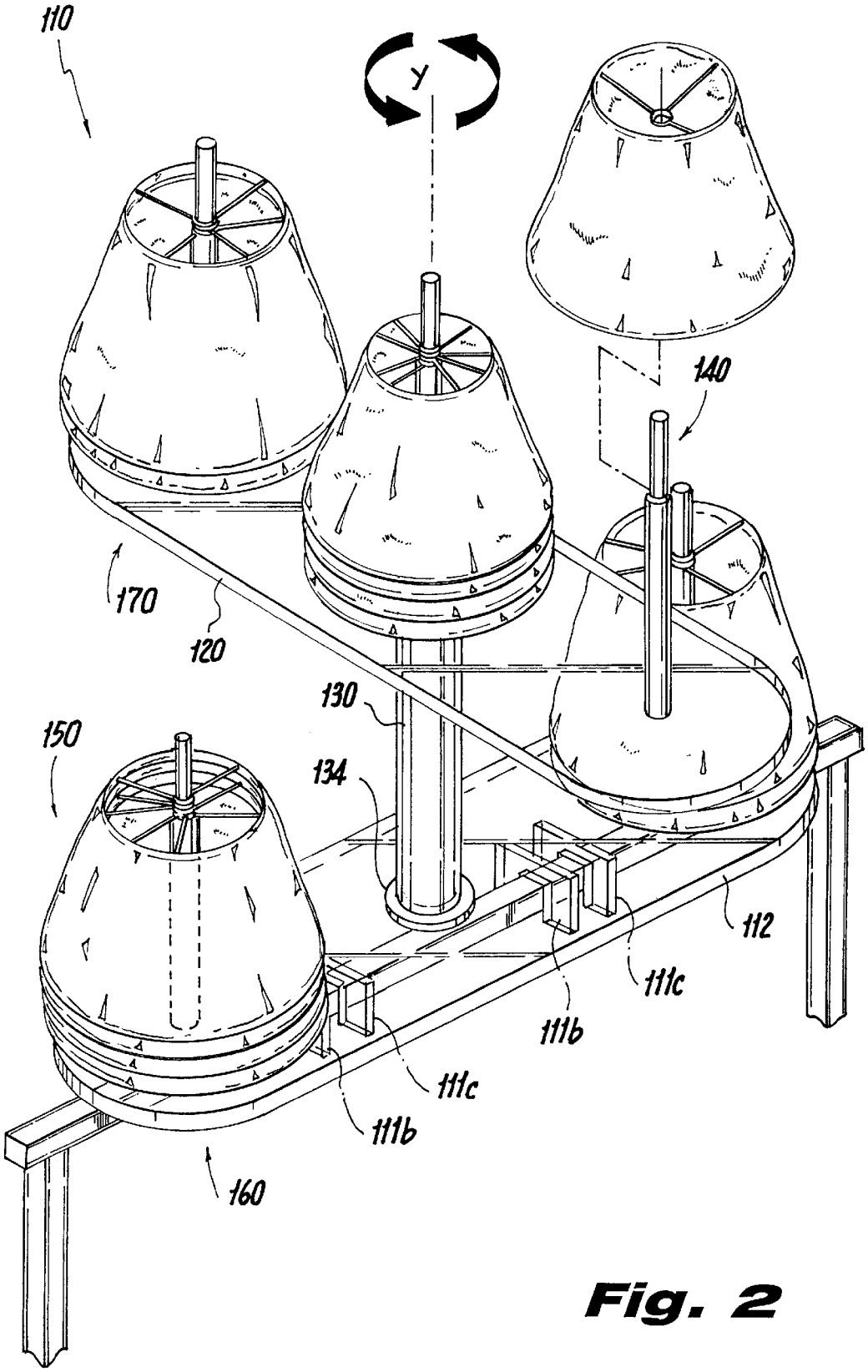
FIG. 2 is a perspective view of the display system of FIG. 1 with a plurality of nested sets of lamp shades displayed thereon.

Referring now in detail to FIG. 1, display apparatus 110 includes a first display unit 160 having an elongated base portion 112 defining a planar top surface 112*a* and a planar bottom surface 112*b*. An upstanding axial mast 126 extends from the top surface 112*a* along a central axis "y" of the first display unit 160 to rotatably support a second elongated display member 170, which will be discussed in greater detail below. Upstanding posts 140 extend from the top surface 112*a* of elongated base portion 112 along a longitudinal axis "x" for supporting a plurality of nested lamp shades 150, as illustrated in FIG. 2. Longitudinal axis "x" extends generally perpendicular to central axis "y". Preferable, first and second engagement struts 111 depend perpendicularly from the bottom surface 112*b* of the elongated base portion 112 for securing the first display unit 160 to a supporting structure. Alternative supporting structures can be employed without departing from the spirit and scope of the subject invention.

With continuing reference to FIG. 1, each upstanding post 140 is centrally disposed between the central axis "y" and a respective end of the base portion 112. Preferably, the upstanding posts 140 are rod shaped and oriented perpendicular to the top surface 112*a* of the elongated base portion 112. It is envisioned that each upstanding post has an upper portion 140*a* and a lower portion 140*b*. The diameter of upper portion 140*a* is less than that of the lower portion 140*b* so as to create a shoulder area 140*c* therebetween. In use, the upper portion 140*a* extends through the mounting apertures of a lamp shade allowing it to rest upon shoulder 140*c*.

Engagement struts 111, in the form of slotted brackets, configured to engage a supporting structure are also shown in FIG. 1. Engagement struts 111 can be formed from a unitary piece of material such as aluminum or assembled from several components. The top portion 111*a*, which is attached to bottom surface 112*b* of elongated base portion 112, can define apertures (not shown) for receiving fasteners used to mount engagement strut 111 to the bottom surface 112*a*. Alternatively, the top portion 111*a* may be secured to the shelf by an adhesive or other technique as are well known in the art. Opposed sidewalls 111*b* and 111*c* depend from the top portion 111*a* of engagement struts 111 to define an open channel therebetween dimensioned and configured to interface with a vertical member of a supporting structure.

In a preferred embodiment, the sidewalls 111*b*, 111*c* depend perpendicularly from the top portion 111*a* and slots are formed therein to secure the first display unit 160 securely to a vertical portion of a supporting structure. The sidewalls 111*b* and 111*c* are preferably wide enough and spaced far enough apart to provide stability without requiring permanent attachment to a supporting structure. Thus, the display system 110 can be moved with minimum effort from location to location within a store.

Those skilled in the art will readily appreciate that the configuration of the engagement struts 111 can vary from the construction disclosed herein without departing from the spirit and scope of the subject invention. Other structures equivalent to the legs may be employed to form the mounting support such as, for example, a three legged arrangement, a leg which attaches to the supporting structure or the like. By way of example, the supporting structure may be an existing display shelf unit containing items such as bedding, window treatments or accessories that match or coordinate with the displayed lamp shades.

With continuing reference to FIG. 1, upstanding axial mast 126 is tubular in shape and aligned with central axis "y" of the elongated base portion 112. In a preferred embodiment, the axial length of the upstanding axial mast 126 along the central axis is approximately 14.0 inches. It is envisioned that the upstanding axial mast 126 may include a collar (not shown) which would move along the central axis "y" to selectively adjust the vertical spacing between the first display unit 160 and second display member 170. Thus, the first display member can accommodate lamp shades of different heights.

In another preferred embodiment (not shown), the upstanding axial mast 126 and second display member 170 would be absent from the display apparatus 110. The elongated base portion 112 would have a third upstanding post to accommodate a third stack of nested lamp shades and the third upstanding post would be located on the top surface 112*a* of the elongated base portion 112 aligned with the central axis "y".

Referring again to FIG. 1, lamp shade display apparatus 110 further includes second display member 170 which includes an elongated shelf portion 120 defining a planar top surface 120*a* and a planar bottom surface 120*b*. A pole 130 depends from the bottom surface 120*b* of the elongated shelf portion 120 along central axis "y" for coupling the second display member 170 to the first display unit 160. Pole 130 has a washer 134 on the distal end thereof to form an opening slightly larger than the outer diameter of upstanding axial mast 126. In a preferred embodiment, the upstanding axial mast 126 has an outer diameter of approximately 1.25 inches and the washer 134 has an opening of approximately 1.375 inches in diameter. When assembled, the depending pole 130 acts as a rotatable sleeve around the upstanding axial mast 126, thus facilitating relative rotation of the second display member 170 with respect to the first display member 160. This arrangement facilitates the ready removal of a lamp shades from the first display member 160 without interfering with the second display member 170. It is envisioned that when the upstanding axial mast 126 has a collar, the washer 134 of pole 130 will rest upon the collar. As mentioned above, the vertical adjustment of the collar will vary the vertical spacing between the first display unit 160 and second display member 170.

Referring now to FIG. 2, in operation, when a stack of nested lamp shades 150 is displayed on each upstanding post 140, only the first display member 160 is stationary with respect to the supporting structure. The optional second display member 170 of apparatus 110 is independently rotatable about central axis "y" to facilitate the movement of a selected stack of nested lamp shades to a position in which the selected stack is readily removable. Thus, the lamp shades on the display apparatus are maintained and accessed in an efficient and aesthetically pleasing manner.

Figure 3:
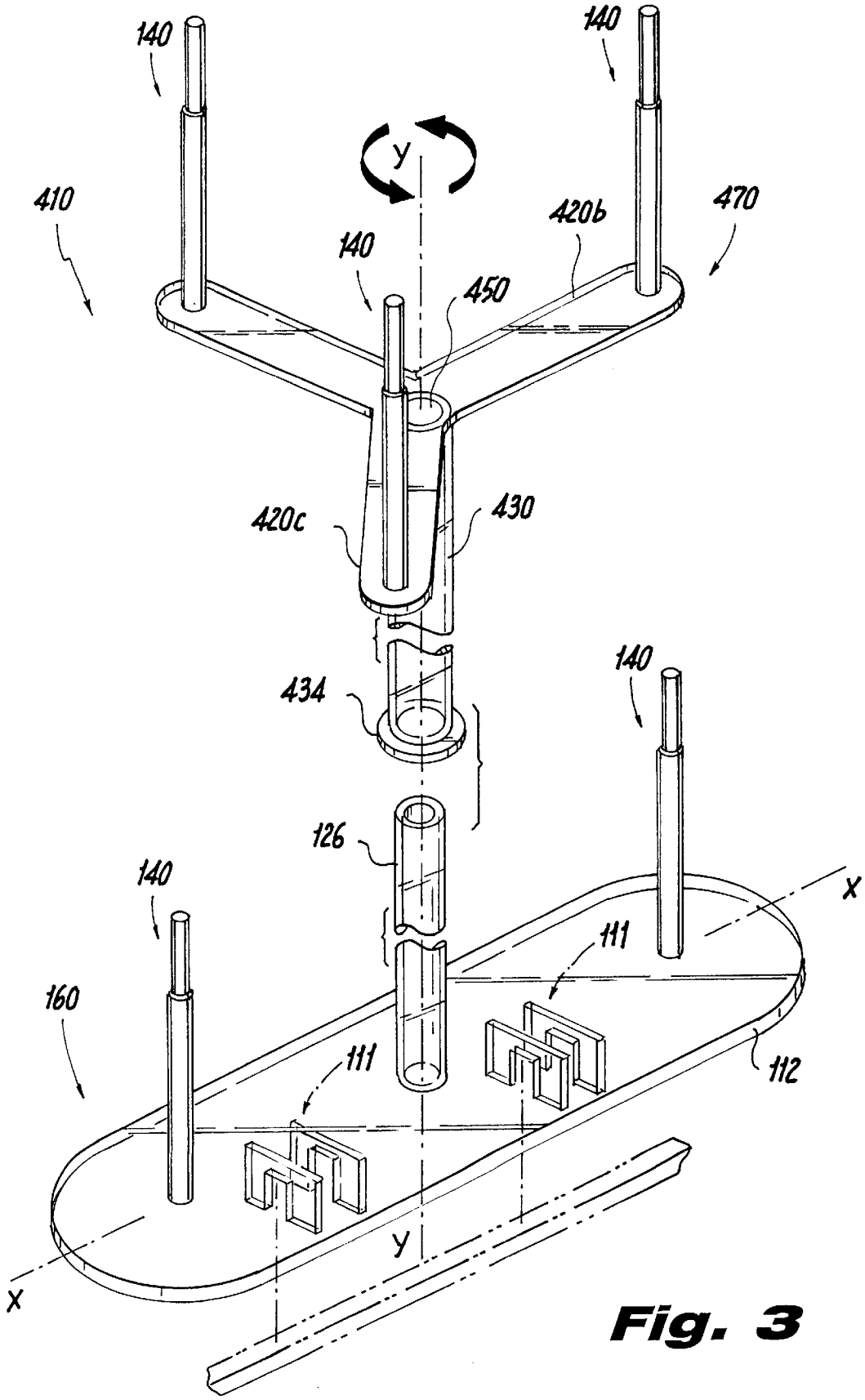
FIG. 3 is a perspective view of a display system constructed in accordance with another preferred embodiment of the subject invention.

Referring now to FIG. 3, there is illustrated another preferred embodiment of the subject invention designated generally by reference number 410. Display system 410 has a first display member 160, as described above with reference FIG. 1, and a second display member 470. Second display member 470 has a central hub portion 450 defining a bottom surface. A pole 430 depends from the bottom surface of the central hub portion 450 along central axis "y" for coupling the second display member 470 to the first display member 160. Three circumferentially spaced apart arms 420*a*, 420*b* 420*c* depend radially outwardly from central hub portion 450.

A washer 434 is disposed on the distal end of pole 434 to form an opening slightly larger than the outer diameter of upstanding axial mast 126. When assembled, the depending pole serves as a rotatable sleeve around the upstanding axial mast, thus facilitating relative rotation of the second display member 170 with respect to the first display member 160. It is envisioned that when the upstanding axial mast 126 has a collar, the washer 434 of pole 430 will rest upon the collar. As a result, the vertical adjustment of the collar will vary the vertical spacing between the first display unit 160 and the second display member 470.

Preferably, the hub portion 450, pole 430 and the three spaced apart arms 420*a*, 420*b*, 420*c* are monolithically formed. However, it is envisioned that the second display member 470 may be assembled from a plurality of separate structural components. Upstanding posts 140 extend from each of three spaced apart arms 420*a*, 420*b*, 420*c* of second display member 470 for supporting stacks of nested lamp shades. The upstanding posts 140 on each spaced apart arm 420*a*, 420*b*, 420*c* are disposed intermediate the central hub portion and the radially outer end of the arm with which each is associated. Thus, the load supported by each arm will be centrally located, lending to the stability of display system 410.

Although the subject invention has been described with respect to preferred embodiments, it is apparent that modifications and changes can be made thereto without departing from the spirit and scope of the invention as defined by the claims.

What is claimed is:

1. A display system for lamp shades mountable upon a supporting structure comprising:

a) an elongated base portion having opposed top and bottom planar surfaces defining a longitudinal axis and a central axis extending generally perpendicular to said longitudinal axis;

b) at least first and second upstanding posts extending from the top surface of the base portion, said first upstanding post disposed between a first end of said elongated base portion and said central axis, said second upstanding post disposed between a second end of said elongated base portion and said central axis; and c) first and second struts depending from the bottom surface of the elongated base portion for securing the base portion to a supporting structure.

2. A display system as recited in claim 1, wherein said top surface of said elongated base member includes a third upstanding post in axial alignment with said central axis.

3. A display system as recited in claim 1, wherein said top surface of said elongated base member includes an upstanding axial mast in axial alignment with said central axis for supporting a display member.

4. A display system as recited in claim 3, further comprising a display member having opposed top and bottom planar surfaces, at least third and fourth upstanding posts extending from said top planar surface of the display member and a pole depending from said bottom planar surface of the display member for engaging said axial mast.

5. A display system as recited in claim 3, wherein said display member has a, hub portion and at least two circumferentially spaced apart radially extending arms.

6. A display system as recited in claim 5, wherein each of said at least two circumferentially spaced apart arms has an upstanding post thereon.

7. A display system as recited in claim 6, wherein each upstanding post is disposed centrally between said hub portion and distal ends of said at least two circumferentially spaced apart arms.

8. A display system as recited in claim 3, wherein said upstanding axial mast is configured to facilitate selective vertical positioning of said display member along said central axis.

9. A display system as recited in claim 1, wherein each upstanding post has an upper portion with an upper diameter and a lower portion with a lower diameter, wherein said upper diameter is less than said lower diameter of said lower portion so as to form a shoulder therebetween.

10. A display system for lamp shades mountable upon a supporting structure comprising:

a) an elongated base portion having opposed top and bottom planar surfaces defining a longitudinal axis and a central axis extending generally perpendicular to said longitudinal axis, wherein said top surface of said elongated base member includes an upstanding axial mast in axial alignment with said central axis for supporting a display member;

b) at least first and second upstanding posts extending from the top surface of the base portion, said first upstanding post disposed between a first end of said elongated base portion and said central axis, said second upstanding post disposed between a second end of said elongated base portion and said central axis;

c) first and second struts depending from the bottom surface of the elongated base portion for securing the base portion to a supporting structure; and d) a display member, rotatably supported on said axial mast having opposed top and bottom planar surfaces, defined by an elongated shelf having at least first and second upstanding posts extending from said top surface thereof and a pole depending from said bottom surface thereof for engaging said axial mast.

11. A display system as recited in claim, 10, wherein said pole is defined by an elongated tubular member having an axial bore therethrough for receiving said axial mast.

12. A display system for lamp shades mountable upon a supporting structure comprising:

a) an elongated base portion having opposed top and bottom planar surfaces defining a longitudinal axis and a central axis extending generally perpendicular to said longitudinal axis, wherein said top surface of said elongated base member includes an upstanding axial mast in axial alignment with said central axis for supporting a display member;

b) at least first and second upstanding posts extending from the top surface of the base portion, said first upstanding post disposed between a first end of said elongated base portion and said central axis, said second upstanding post disposed between a second end of said elongated base portion and said central axis;

c) first and second struts depending from the bottom surface of the elongated base portion for securing the base portion to a supporting structure; and d) a display member rotatably supported on said axial mast and having a hub portion and at least two circumferentially spaced apart radially extending arms depending from said hub portion for supporting a plurality of nested lamp shades.

13. A display stand as recited in claim 12, wherein each radially extending arm has an upstanding post provided thereon for supporting a plurality of nested lamp shades.

14. A display stand as recited in claim 12, wherein said display member has three circumferentially space apart radially extending arms depending from said hub portion for supporting a plurality of nested lamp shades.

* * * * *